US006936346B2

(12) United States Patent
Chen et al.

(10) Patent No.: US 6,936,346 B2
(45) Date of Patent: Aug. 30, 2005

(54) FUNCTIONAL COMPOSITE FIBER AND PREPARATION THEREOF AND SPINNERET FOR PREPARING THE SAME

(75) Inventors: Lien-Tai Chen, Taoyuan (TW); Shyue-Lih Ferng, Hsinchu (TW)

(73) Assignee: Industrial Technology Research Institute (TW)

( * ) Notice: Subject to any disclaimer, the term of this patent is extended or adjusted under 35 U.S.C. 154(b) by 0 days.

(21) Appl. No.: 10/715,505

(22) Filed: Nov. 19, 2003

(65) Prior Publication Data

US 2004/0109999 A1 Jun. 10, 2004

(30) Foreign Application Priority Data

Nov. 19, 2002 (KR) ..... 091133766

(51) Int. Cl.[7] ..... D01F 8/00

(52) U.S. Cl. ..... 428/397; 428/373; 428/370; 428/374; 428/397

(58) Field of Search ..... 428/397, 373, 428/370, 374

(56) References Cited

U.S. PATENT DOCUMENTS

| | | | | | |
|---|---|---|---|---|---|
| 3,860,679 | A | * | 1/1975 | Shemdin | 264/40.1 |
| 4,861,651 | A | * | 8/1989 | Goldenhersh | 442/43 |
| 5,057,368 | A | * | 10/1991 | Largman et al. | 428/397 |
| 5,277,976 | A | * | 1/1994 | Hogle et al. | 428/397 |
| 5,707,735 | A | * | 1/1998 | Midkiff et al. | 428/373 |
| 6,037,280 | A | * | 3/2000 | Edwards et al. | 442/131 |
| 6,093,491 | A | * | 7/2000 | Dugan et al. | 428/397 |

* cited by examiner

*Primary Examiner*—N. Edwards
(74) *Attorney, Agent, or Firm*—Sughrue Mion, PLLC

(57) ABSTRACT

A functional composite fiber and preparation thereof, and a spinneret for preparing the same. The functional composite fiber comprises a plurality of the T-lobes connected with each other at their bases, wherein the caps of the T-lobes contain a component, and their bases T-lobes contain the component and an additive. The additive is not exposed on the surface of the fiber thereby preventing post-manufacturing abrasion of the spinning machine.

6 Claims, 7 Drawing Sheets

FUNCTIONAL COMPOSITE FIBER AND PREPARATION THEREOF AND SPINNERET FOR PREPARING THE SAME

BACKGROUND OF THE INVENTION

1. Field of the Invention

The present invention relates to a functional composite fiber. More particularly, the present invention relates to a composite fiber containing a functional component not exposed on the surface thereof, thereby avoiding abrasion of the spinning machine during post-manufacturing.

2. Description of the Related Arts

Currently, composite fibers contain T-shaped lobes and open channels formed thereon, provide the ability to wick perspiration away from the human body. As multi-functional fibers have become a trend, blending inorganic chemicals such as anti-ultraviolet (anti-UV) agent, far-intra red (far-IR) agent, or anti-bacterial & mildew-retarding agents into multi-function fiber groups has become widespread. For example, U.S. Pat. No. 5,057,368 discloses a trilobal or quadrilobal fiber composed of one polymer or a mixture of various polymers; U.S. Pat. No. 6,093,491 discloses a thermoplastic fiber comprising a fiber with one or more internal lengthwise open channels and a durable hydrophilic surface modifier associated with the channels; and U.S. Pat. No. 5,707,735 discloses a conjugate multilobal fiber comprising at least two polymers arranged with at least one polymer occupying a portion of the fiber and at least one other polymer having a lower melting point than the first portion polymer occupying an outer portion of the fiber. Fiber containing inorganic chemicals, however, may abrade the yarn guide, tension sensor, or the PU disc during post-manufacturing processes and result in broken filaments or skittery dyeing. Therefore, improved composite fibers and the manufacturing method thereof is required.

SUMMARY OF THE INVENTION

It is a primary object of the present invention to provide a functional composite fiber with an unexposed inorganic chemical which does not contact the yarn guide or PU disc, preventing post-manufacturing abrasion of these elements. The abrasion of these elements may affect the quality of fiber products and also incur extraneous expenses.

Accordingly, the present invention provides a functional composite fiber comprising a plurality of the T-lobes connected to each other at their bases. The caps of the T-lobes contain a component and the bases of the T-lobes contain the component and an additive. The additive is not exposed on the surface of the fiber; therefore, the yarn guide and PU disc are not abraded by the additive. The quality of fiber products can be maintained, and extraneous costs for maintaining the abraded yarn guide and PU disc can be prevented. The fiber of the present invention can be a porous hollow fiber with polygonal cross-sections while the caps of the T-lobes are connected to each other or a non-hollow fiber with multilateral cross-section while the caps of the T-lobes are not connected, for use in autumn/winter or spring/summer garments respectively.

In another aspect of the present invention, a spinneret is provided for the manufacture of the previously described fiber. The spinneret comprises a plurality of rectangular first exits extending outward to form an equilateral polygon, and a plurality of rectangular second exits radially arranged from the mass center of the equilateral polygon to each side of equilateral polygon. The length of the first exits can be longer or shorter than that of the second exits to manufacture the porous hollow fiber with polygonal cross-section or the non-hollow fiber with multilateral cross-section respectively.

In another aspect of the present invention, a manufacturing method for a functional composite fiber is provided. The method comprises producing the functional composite fiber by the above mentioned spinneret. The fiber is composed of a first component and a second component, and the first component is extruded from the first exit while the second component is extruded from the second exit. When the length of the first exit is longer than that of the second exit and the gap between adjacent first exits is less than 0.1 mm, the porous hollow fiber with polygonal cross-section can be obtained. When the length of the first exit is shorter than that of the second exit, the non-hollow fiber with multilateral cross-section can be obtained.

BRIEF DESCRIPTION OF THE DRAWINGS

The present invention will be more fully understood and further advantages will become apparent when reference is made to the following description of the invention and the accompanying drawings in which:

FIG. 1A represents the cross-section of 3T fibers; FIG. 1B represents the cross-section of tri-porous hollow fibers.

FIG. 3A shows the spinneret for the functional composite fiber in example 1; FIG. 3B shows the spinneret for the functional composite fiber in example 2.

FIG. 8A shows the yarn guide after 7-day (168 hours) spinning with the spinneret of the present invention; FIG. 8B shows the yarn guide after 1-day (24 hours) spinning by a regular spinneret with polyester fiber containing inorganic chemicals; FIGS. 8C and 8D are enlarged photos of FIG. 8D in different views.

DETAILED DESCRIPTION OF THE INVENTION

Without intending to limit it in any manner, the present invention will be further illustrated by the following description.

The functional composite fiber of the present invention features at least two T-lobes, preferably three T-lobes, connected at their bases. The caps of the T-lobes contain a first component and the bases of the T-lobes contain a second component including the first component and an additive. When the fiber is a porous hollow fiber with polygonal cross-section, the cap of each T-lobe is connected to another T-lobe or to a non-hollow fiber with multilateral cross-section when the cap of each T-lobe is not connected to another cap. The component includes, but is not limited to, polyester, nylon, polyolefin, poly(acrylonitrile)(PAN), or cellulose; the polyester includes polyethylene terephthalate (PET), polybutylene terephthalate (PBT), or polypropylene terephthalate (PPT); nylon includes N6 or N66; polyolefin include polypropylene (PP) or polyethylene (PE). Preferably, the component is PET. The additives include, but are not limited to, anti-bacterial & mildew-retarding agents, anti-conductive agent, anti-UV agent, or far-IR agent.

Figure 2:
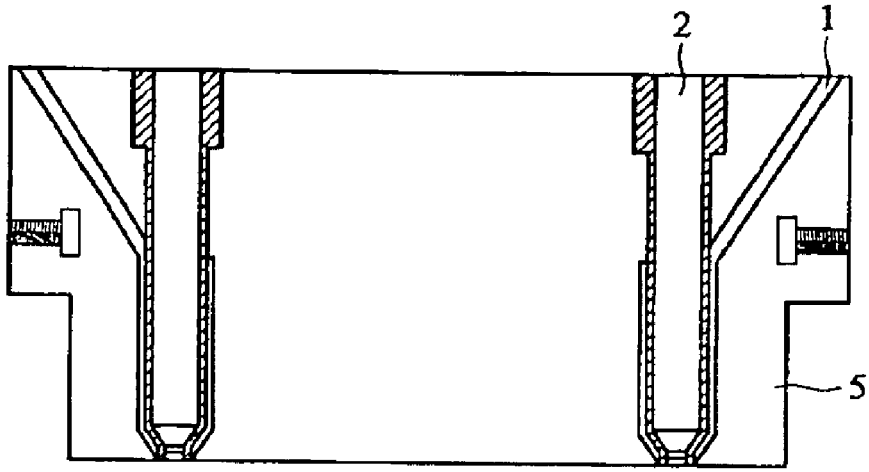
FIG. 2 is a lateral view showing the spinning machine for the functional composite fiber of the present invention.
Figure 3A:
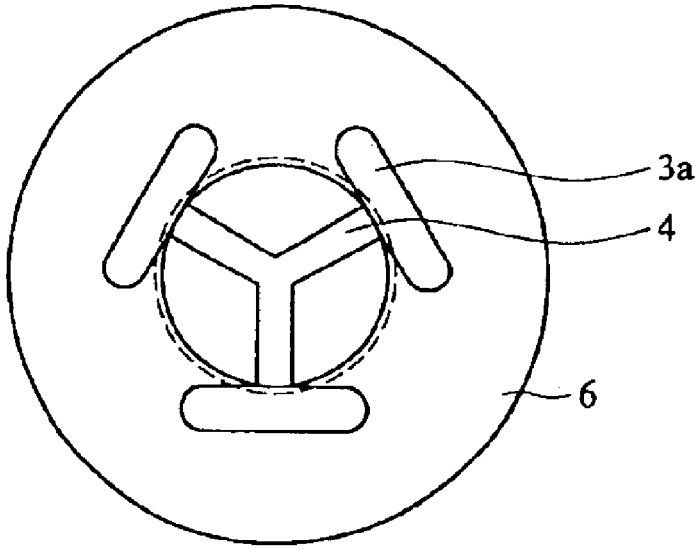
FIGS. 3A–3B are diagrams showing the spinnerets for the functional composite fiber of the present invention.
Figure 3B:
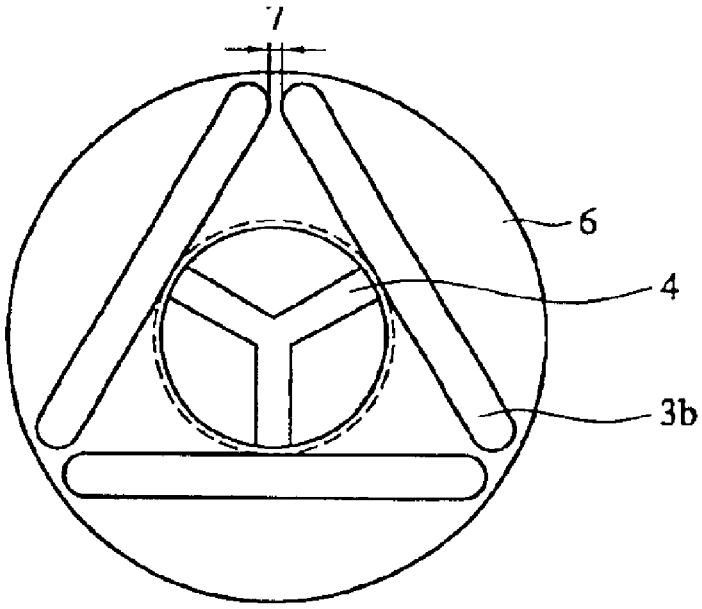

The manufacturing method of the present invention is performed by an intubated composite spinning machine 5 as shown in FIG. 2 and spinneret 6 as shown in FIGS. 3A and 3B. The intubated composite spinning machine 5 has an inner tube 2 and an outer tube 1. The spinneret of the present invention includes a plurality of square first exits (3*a* and 3*b*) extending outward to form an equilateral polygon, and a plurality of square second exits 4 radially arranged from the mass center of the equilateral polygon to each side of equilateral polygon. Typically there are three square first exits which form an equilateral triangle as shown in FIGS. 3A and 3B. In addition, the adjacent first and second exits form a right angle. The above mentioned second component, a melting polymer containing an abrasive inorganic chemical, is introduced into the inner tube 2 of the composite spinning machine 5 and extruded from the second exits 4 of spinneret 6 to form the bases of the fibers. The first component is introduced into the outer tube 1 of composite spinning machine 5 and extruded from the first exits (3*a* and 3*b*) to form the caps of the fibers. The inorganic additive of the obtained fiber does not contact with the yarn guide and the PU disc, thus preventing abrasion during post-manufacturing and maintaining fiber product quality. In addition, as shown in FIGS. 3A and 3B, the non-hollow fiber with multilateral cross-section can be obtained using the spinneret 6 of FIG. 3A, in which the first exits 3*a* are shorter than the second exits 4; or the porous hollow fiber with polygonal cross-section can be obtained using the spinneret 6 of FIG. 3B, in which the first exits 3*b* is longer than the second exits 4 and the two adjacent first exits 3*b* have a gap 7. The non-hollow fiber with multilateral cross-section and the porous hollow fiber with polygonal cross-section can be applied in spring/summer and autumn/winter garments respectively.

Practical examples are described herein.

Figure 1A:
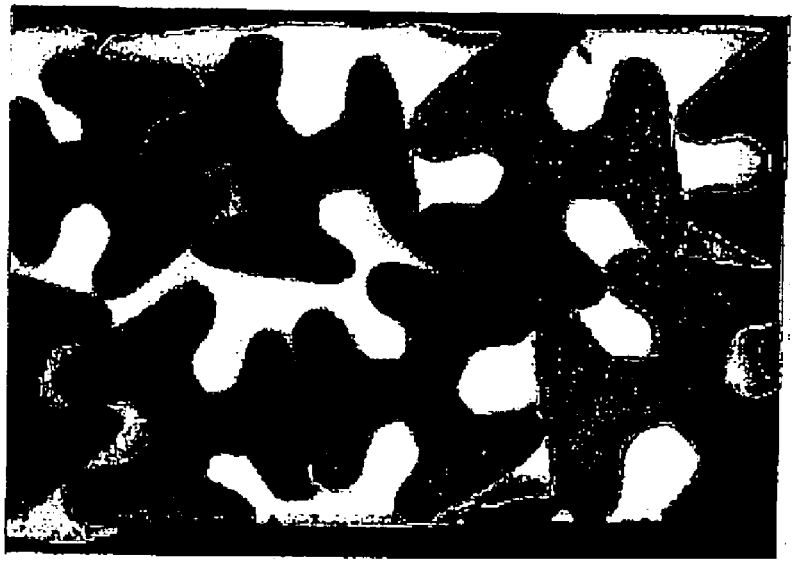
FIG. 1A (PRIOR ART)
FIGS. 1A–1B are cross-sections showing the fiber with single component of the prior art.
Figure 1B:
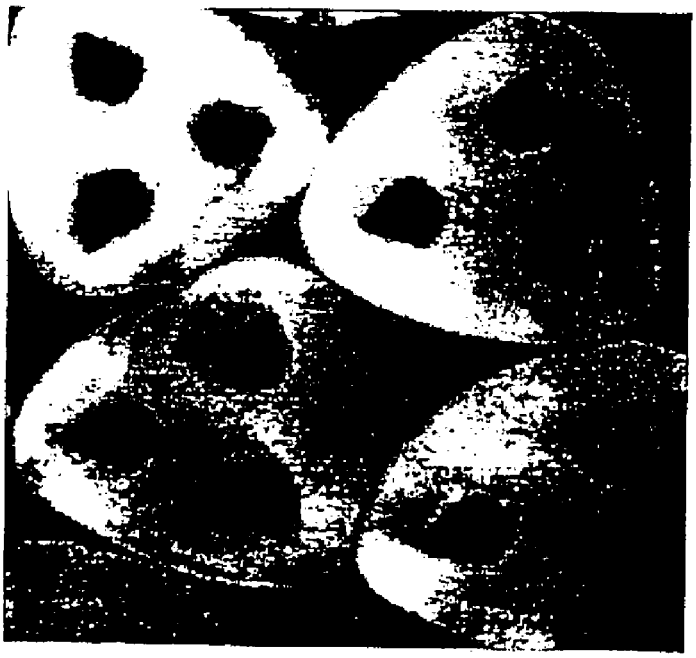
FIG. 1B (PRIOR ART)

CONTROL: Manufacture of the Trilobal Non-Hollow and Tri-Porous Hollow Fibers with Single Component The trilobal non-hollow fiber as shown in FIG. 1A and the tri-porous hollow fiber as shown in FIG. 1B were produced by the method known by those skilled in the art using a one-tube spinning machine, a regular trilobal spinneret, and polyethylene terephthalate (PET) as spinning material. The power for FIGS. 1A and 1B is 12.5×20.

EXAMPLE 1

Figure 4:
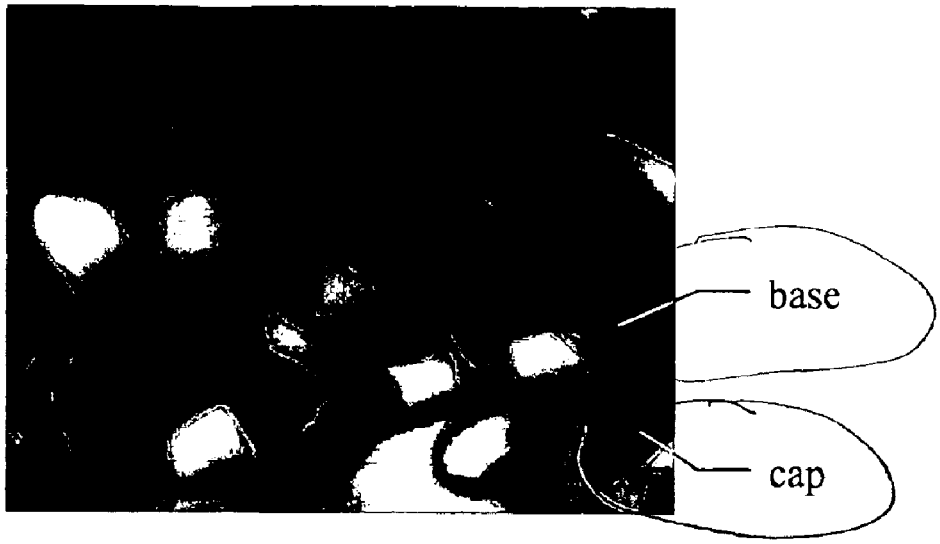
FIG. 4 is a cross-section showing the functional composite fiber in example 1.

Manufacture for the Non-Hollow Composite Fiber with Multilateral Cross-Section of the Invention The non-hollow composite fiber with multilateral cross-section was prepared using the spinning machine as shown in FIG. 2 and the spinneret as shown in FIG. 3A. The spinning materials are polyethylene terephthalate (PET) extruded from the second exit and PET supplemented with anti-UV agent, for example, 2.3% $TiO_2$, extruded from the first exit. The cross-section of resulting fibers is shown in FIG. 4 with a power of 12.5×20. The tenacity of the fiber is over 3.0 g/den, the fineness is 1.5~3.0 dpf, and the elongation is 20~30%.

EXAMPLE 2

Figure 5:
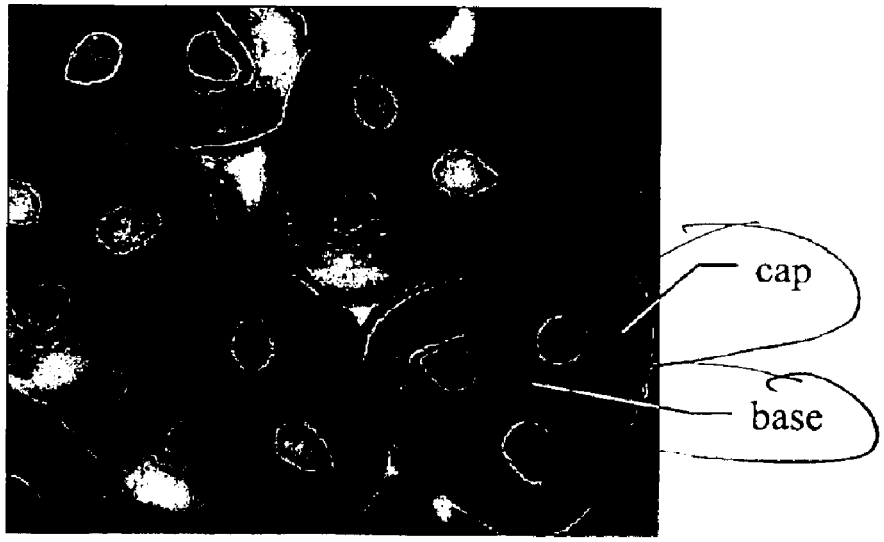
FIG. 5 is a cross-section showing the functional composite fiber in example 2.

Manufacture of the Porous Hollow Composite Fiber with Polygonal Cross-Section of the Invention The porous hollow composite fiber with polygonal cross-section was prepared using the spinning machine as shown in FIG. 2 and the spinneret as shown in FIG. 3B. The spinning materials are PET extruded from the second exit and PET supplemented with far-IR agent, for example, 0.3~1% $ZnO_2$, extruded from the first exit. The cross-section of resulting fibers is shown in FIG. 5 with a power of 12.5×20. The tenacity of the fiber is over 3.5 g/den, the fineness is 1.5~3.0 dpf, and the elongation is 20~30%.

EXAMPLE 3

Properties of the Non-Hollow Composite Fiber with Multilateral Cross-Section in the Present Invention Drying speed assay: the sample of 10×10 $cm^2$ is placed in a constant temperature (23° C.) and humidity (65% RH) for 24 hours. The sample is then placed on a laboratory balance, and an amount of water ($W_1$) is dropped into the sample from 1 cm height. The amount of residual water ($W_2$) is measured after 12 min, and the evaporation rate is calculated as:

$$\text{Evaporation rate } (\%)=(W1-W2)/W1\times 100\%$$

Figure 6:
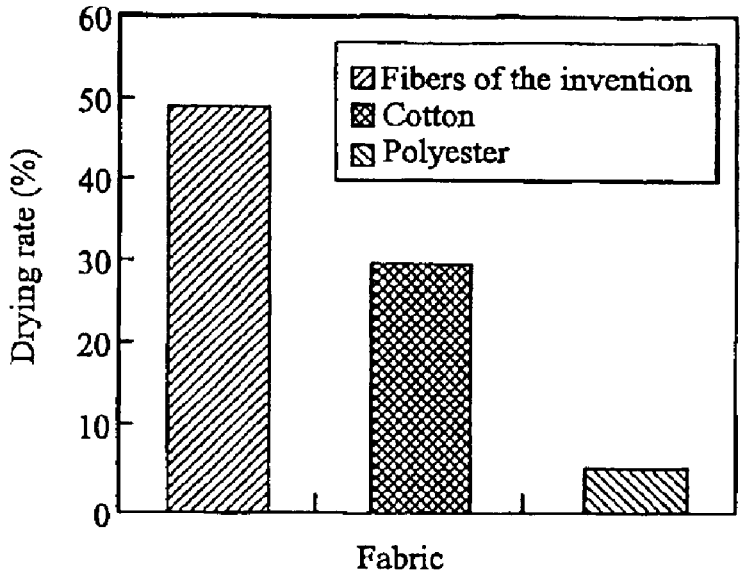
FIG. 6 is a diagram showing the comparison of drying speed between the functional composite fiber in example 1 of the invention and the fiber of prior art.

The results are shown as FIG. 6. The comparison of drying speed in the fiber of the present invention, cotton, and general polyester shows that the drying speed of the fiber in the present invention (50%) is better than cotton (about 30%) and general polyester (less than 10%).

EXAMPLE 4

Properties of the Porous Hollow Composite Fiber with Polygonal Cross-Section in the Present Invention Temperature change assay: the measurement is performed by an AGEMA Thermalvision 900 heat conductivity sensor using a 500 W halogen lamp as a heat source. The sample is placed 100 cm under the heat source for 10 min. The temperature differences are measured before and after exposure to the heat source.

Figure 7:
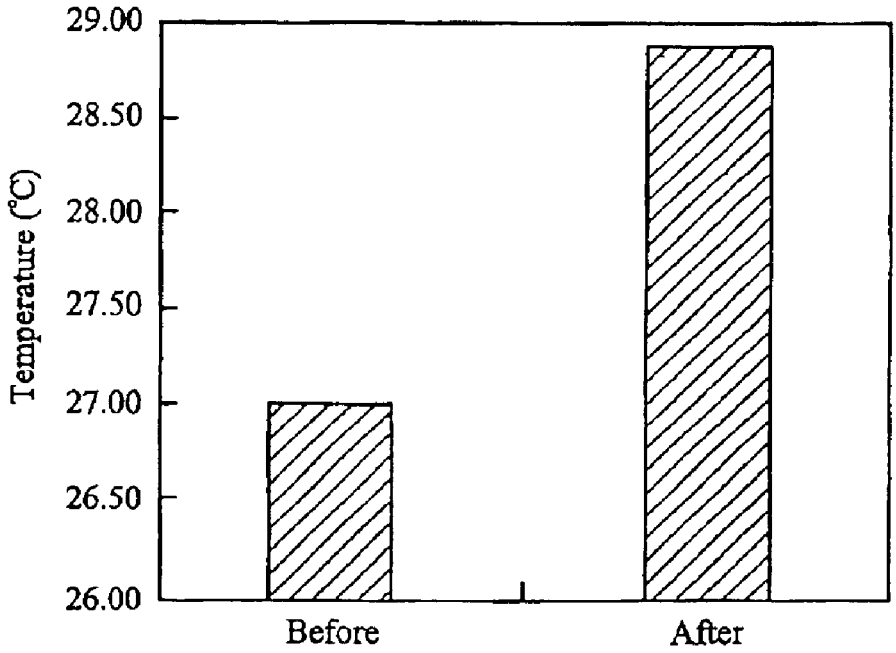
FIG. 7 is a diagram showing the comparison of heat retention between the functional composite fiber in example 2 of the invention and the fiber of prior art.

The results are shown as FIG. 7. The temperature comparison of the fiber in the present invention before and after exposure to the heat source reveals that it has excellent heat-insulation ability.

EXAMPLE 5

Abrasion Test for the Fiber of the Present Invention

Using a 36-pore spinneret under a yield of 0.99 g long fiber/min/pore and a spinning speed of 2800 m/min, the abrasion of yarn guide was performed.

Figure 8A:
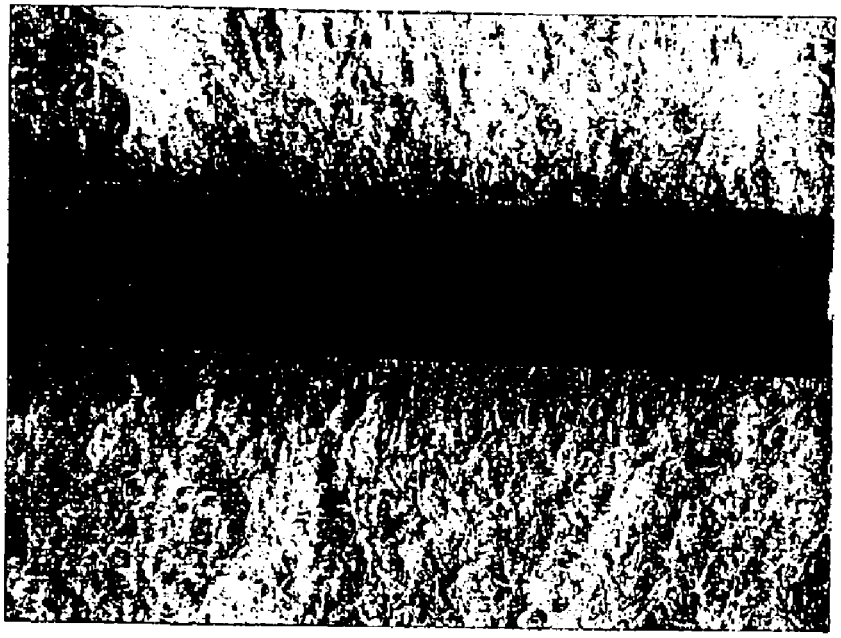
FIGS. 8A–8D are diagrams showing the abrasion of the yarn guide.
Figure 8B:
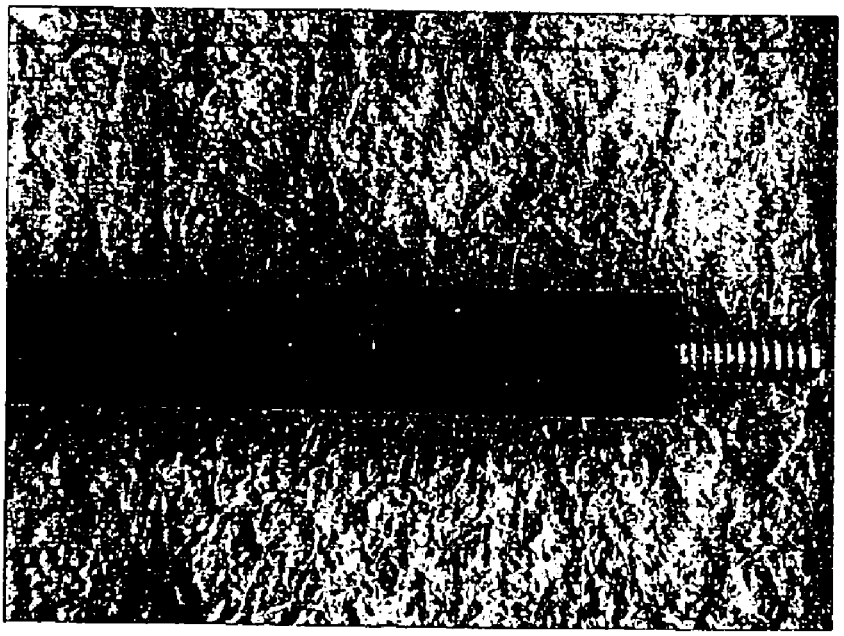
Figure 8C:
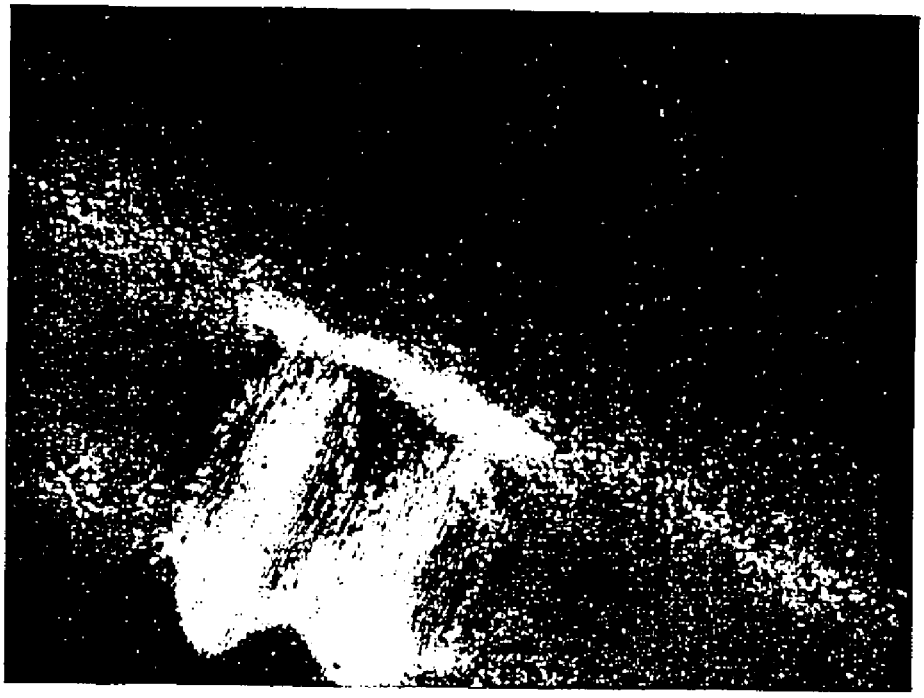
Figure 8D:
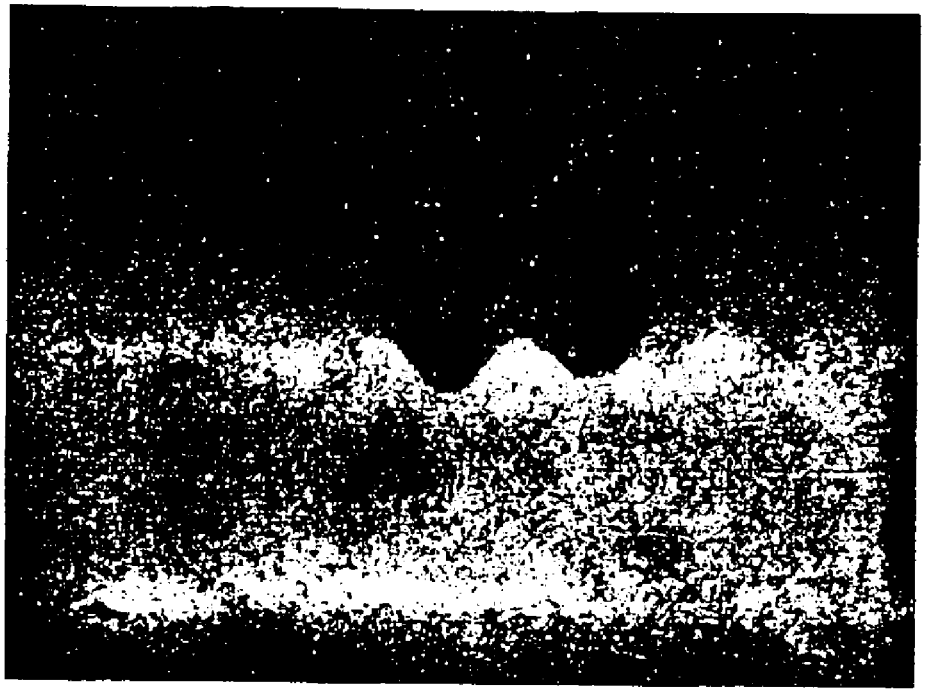

For the manufacture of general polyester fiber supplemented with inorganic additives, using the conventional spinneret, the yarn guide was abraded after one day (24 hours) as shown in FIGS. 8B–8D; FIGS. 8C and 8D are photographs showing the amplified abrasion site of FIG. 8B in different views. Using the spinneret of the present invention, the yarn guide remained intact after 7-days (168 hours) of spinning.

The manufacture of functional composite fiber in the present invention incorporates a specially designed spinneret which prevents the functional component from being exposed on the surface of the fiber, thus preventing abrasion to the yarn guide and PU disc and extraneous cost of fiber. In addition, the size of the first and second exits of the spinneret can be adjusted to form porous hollow fibers with polygonal cross-section or non-hollow fibers with multilateral cross-section. Fabric comprising non-hollow composite fiber with multilateral cross-section features water diffusion and wicking properties; therefore, the fabric does not stick to the skin, and maintains a crisp appearance and provides comfort due to its capillary action. In addition, the inner additive of anti-UV agent features wash resistance and protects the skin from UV radiation. Moreover, fabric comprising porous hollow composite fiber with polygonal cross-section is light weight and provides heat insulation by preventing air convection.

While the invention has been particularly shown and described with the reference to the preferred embodiments thereof, it will be understood by those skilled in the art that various changes in form and details may be made without departing from the spirit and scope of the invention.

What is claimed is:

1. A functional composite fiber, comprising a plurality of T-lobes connected to each other at their bases, wherein the caps of the T-lobes contain a first component; the bases of the T-lobes contain a second component including the first component and an additive; and the caps are substantially free of the second component.

2. The functional composite fiber as claimed in claim 1, wherein the caps of the T-lobes connect with each other to form a porous hollow fiber with polygonal cross-section.

3. The functional composite fiber as claimed in claim 1, wherein the caps of the T-lobes are not connected to each other and form a non-hollow fiber with multilateral cross-section.

4. The functional composite fiber as claimed in claim 1, wherein the component comprises polyester, nylon, polyolefin, poly(acrylonitrile) (PAN), or cellulose.

5. The functional composite fiber as claimed in claim 4, wherein the polyester is polyethylene terephthalate (PET).

6. The functional composite fiber as claimed in claim 1, wherein the additive comprises anti-UV, far-IR, or anti-bacterial & mildew-retarding agents.

* * * * *

UNITED STATES PATENT AND TRADEMARK OFFICE

CERTIFICATE OF CORRECTION

PATENT NO. : 6,936,346 B2
DATED : August 30, 2005
INVENTOR(S) : Lien-Tai Chen and Shyue-Lih Ferng It is certified that error appears in the above-identified patent and that said Letters Patent is hereby corrected as shown below:

Title page,
Item [30], Foreign Application Priority Data, delete "(KR)" and insert -- (TW) -- and delete "091133766" and insert -- 91133768 --.

Signed and Sealed this

Third Day of January, 2006

JON W. DUDAS
*Director of the United States Patent and Trademark Office*